United States Patent [19]

Ogatsu

[11] Patent Number: 4,641,580

[45] Date of Patent: Feb. 10, 1987

[54] CIRCUIT APPARATUS FOR OPERATING FIREWORKS IGNITION

[75] Inventor: Motohiro Ogatsu, Fuchu, Japan

[73] Assignee: Marutamaya Ogatsu Fireworks Co., Ltd., Tokyo, Japan

[21] Appl. No.: 731,239

[22] Filed: May 6, 1985

[30] Foreign Application Priority Data

May 14, 1984 [JP] Japan ..... 59-94553

[51] Int. Cl.[4] ..... F23Q 7/02

[52] U.S. Cl. ..... 102/217; 102/200; 361/249; 361/251

[58] Field of Search ..... 102/200, 217; 361/248-251

[56] References Cited

U.S. PATENT DOCUMENTS

| | | | |
|---|---|---|---|
| 3,409,804 | 11/1968 | Bankston, Jr. | 361/248 |
| 3,531,691 | 9/1970 | Sitler et al. | 361/251 |
| 3,603,844 | 9/1971 | Fritz | 361/251 X |
| 3,675,578 | 7/1972 | Douglas et al. | 361/248 X |
| 4,012,671 | 3/1977 | Vaice | 361/249 |
| 4,325,304 | 4/1982 | Ormiston | 102/217 X |

FOREIGN PATENT DOCUMENTS

| | | | |
|---|---|---|---|
| 801192 | 12/1968 | Canada | 361/249 |
| 428861 | 11/1944 | Italy | 361/248 |

*Primary Examiner*—Peter A. Nelson

*Attorney, Agent, or Firm*—Jordan and Hamburg

[57] ABSTRACT

A circuit apparatus for operating firewirks ignition is used by connecting with a fireworks ignition circuit with a group of ignition ball terminals lined up as multi-step and multi-file coordinates of which the positive terminals are respectively connected with the common positive line of each file through a diode, and the negative terminals with the common negative line of each step. A circuit apparatus for operating fireworks ignition comprises a connected structure of: a group if ignition operating switches with a plural number of poles, the positive terminals and negative terminals on the output side being connected respectively with each of the positive lines commonly used for each file and with each of the negative lines commonly used for each step of the circuit lined up in an optional number of vertical steps and horizontal files; the ignition pilot lamp commonly connected with a pole of each ignition operating switch to be lighted when the ignition operating switch is closed; and a group of block operation switches with a plural number of poles to perform on/off operation of the power source supply in common with each file of the group of ignition operating switches.

6 Claims, 7 Drawing Figures

CIRCUIT APPARATUS FOR OPERATING FIREWORKS IGNITION

BACKGROUND OF THE INVENTION

1. Field of the Invention

This invention is related to the circuit apparatus of fireworks ignition used by connecting to the fireworks ignition circuit on the power source side.

2. Description of the Prior Art

As shown in (a)(b) of FIG. 1 and FIG. 2, the conventional fireworks ignition circuit X1 and X2 connect to the ignition operation circuit systems Y1 and Y2 for fireworks called the ignition balls 10, by connecting positive and negative lines to each of them or by using a negative line for them in common. It means that in case of a hundred ignition balls 10, $100\times2=200$ lines or $100+1=101$ lines are required for the connection with the power source when the conventional circuits X1 and X2 as shown in (a) of FIG. 1 and FIG. 2 are used. On the other hand, the conventional fireworks ignition operation circuit Y1 and Y2 are connected with the power source E only by the application of an intermediating monopolar switch SW on each of the positive lines as shown in (b) of FIG. 1 and FIG. 2, and it is very inconvenient that the conduction after connection and the source voltage must be checked with a tester at each contact. There are also matters to be considered from the safety problems related to the danger of misignition as each line is merely connected through a single switch SW.

Then, this inventor already invented the fireworks ignition circuit $\alpha$ as shown in FIG. 3 to replace the conventional ignition circuits X1 and X2 with. In this invention the group of ignition ball terminals 12 are lined up like coordinates, for example, in 6 steps vertically and 10 files sideways as shown in FIG. 3, and each of the positive terminals 14 of each file is connected with one of the common positive lines L'1 to L'10 through a diode 16, and each of the negative terminals 18 of each step is connected with one of the common negative lines L'A to L'F. Then the current can be transmitted to the ignition balls 10 at any position of the coordinates if the optional combination of the positive lines L'1 to L'10 and the negative lines L'A to L'F is connected to the power source. The number of lines required for the connection with the power source can be remarkably decreased in this fireworks ignition circuit $\alpha$ with 10 positive lines and 6 negative lines, 16 lines in total.

SUMMARY OF THE INVENTION

The principal purpose of this invention is to offer a fireworks ignition operation circuit apparatus to perform the ignition of the fireworks ignition circuit by free remote operation.

Another purpose of this invention is to offer a fireworks ignition operation circuit apparatus on the power source side to perform the selective transmission of the current to the optional ignition balls of the fireworks ignition circuit $\alpha$, to facilitate a series of checking operations, and to secure the safety of ignition time.

The other purposes of this invention will be made clear of themselves by the detailed discription and the attached drawings. dr

BRIEF DESCRIPTION OF THE DRAWINGS

Both FIG. 1 (*a*) and FIG. 2 (*a*) show the conventional fireworks ignition circuits.

DESCRIPTION OF THE PREFERRED EMBODIMENT

Figure 1A:
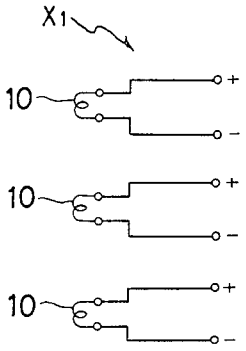
Fig.1(a) PRIOR ART
FIG. 1 (*b*) and FIG. 2 (*b*) show the conventional circuit systems of fireworks ignition operation.
Figure 1B:
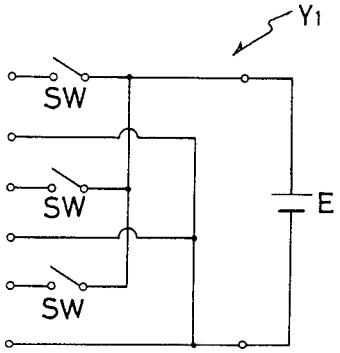
Fig.1(b) PRIOR ART
Figure 2A:
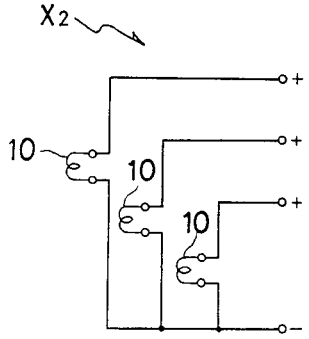
Fig.2(a) PRIOR ART
Figure 2B:
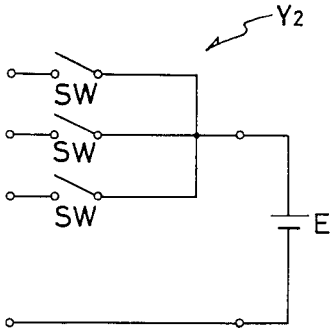
Fig.2(b) PRIOR ART
Figure 3:
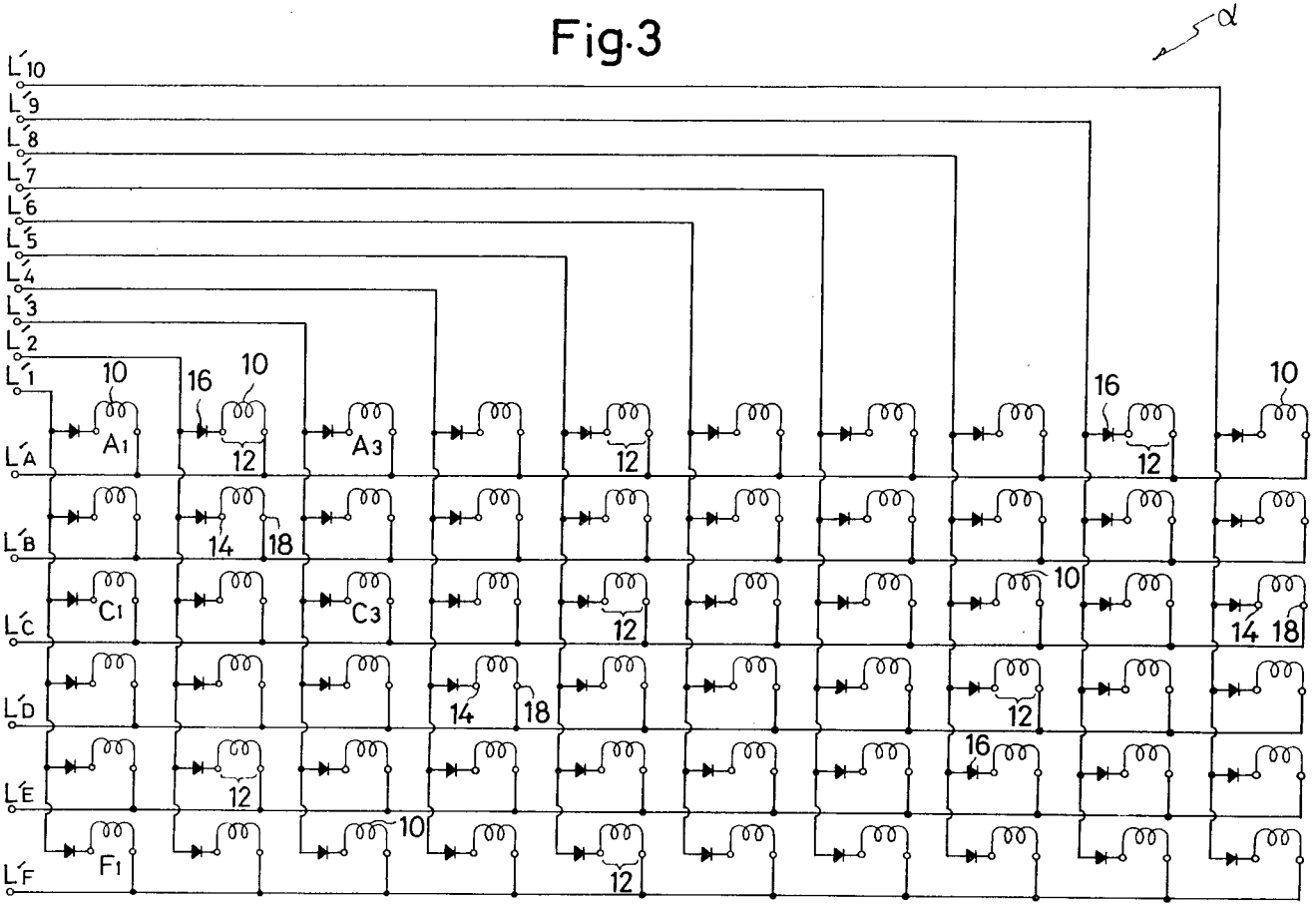
FIG. 3 shows the controlled fireworks ignition circuit on this invention.
Figure 4:
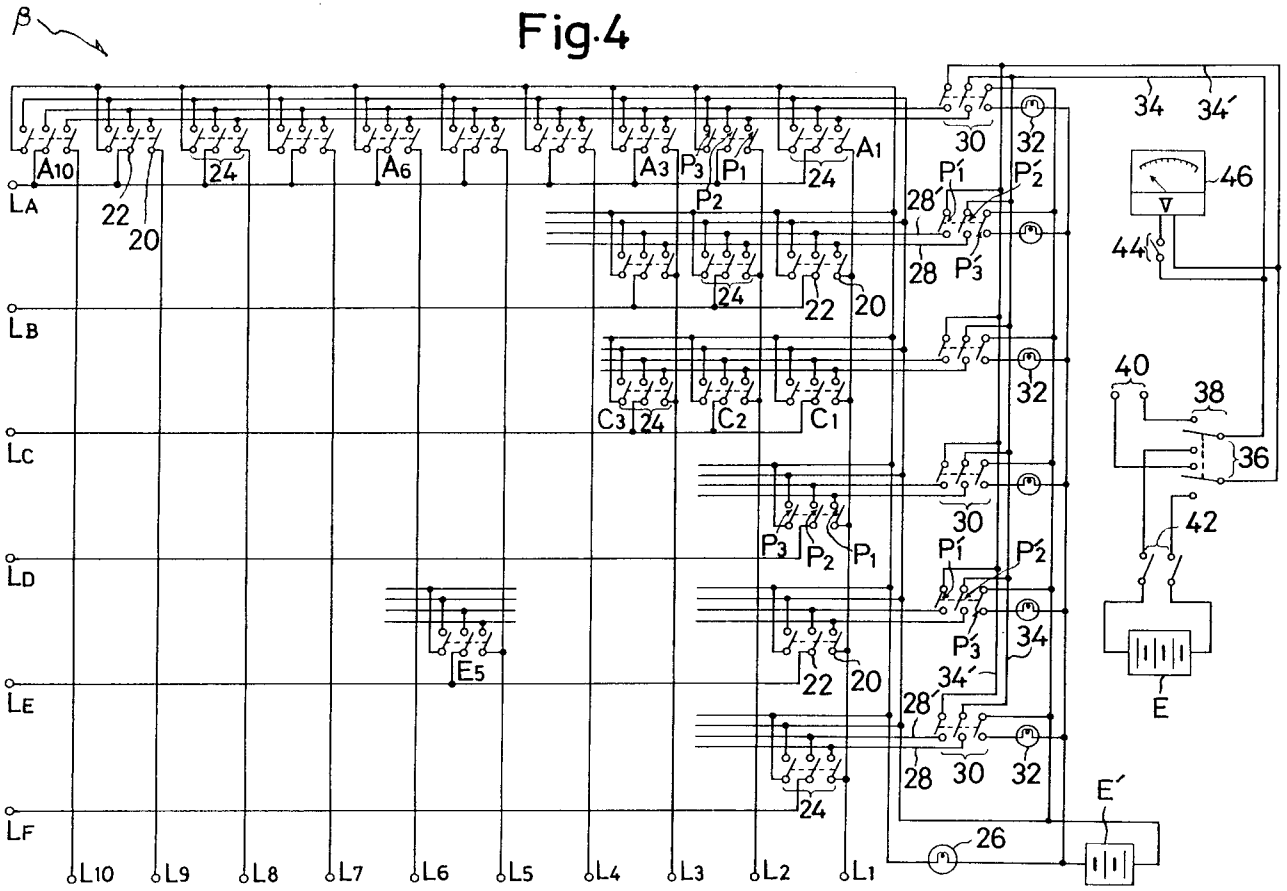
FIG. 4 shows the circuit apparatus for operating fireworks ignition of this invention.

The explanation will be made on an embodiment of this invention referring to FIG. 3 and FIG. 4.

The circuit apparatus for operating fireworks ignition $\beta$ of this invention comprises the following: the circuit lined up in 6 steps vertically and in 10 files sideways with each of the positive terminals 20 of each file on the output side connected with one of the common positive lines L1 to L10 and each of the negative terminals 22 of each step on the output side connected with one of the common negative lines LA to LF; a group of the ignition operation switch 24 made up of three poles, P1 and P2 respectively connected with the corresponding lines and an additional pole P3; the ignition pilot lamp 26 connected with P3 of each ignition operation switch 24 to be lighted when the ignition operation switch 24 is closed; a group of the block operation switch 30 made up of three poles, P'1 and P'2 to open and close the block positive line 28 and the block negative line 28' commonly connecting each of the ignition operation switch 24 on the same step and an additional pole P3; a group of the block pilot lamp 32 connected with P'3 of each block operation switch 30 to be lighted when the corresponding block operation switch 30 is closed; the double-pole double-throw type main switch 38 connecting the power source positive line 34 and the power source negative line 34' connecting the group of the block operation switch 30 in common with the intermediate terminal 36; the test terminal 40 to connect a tester which is not shown in the Figure with one throw side, and the power source E connecting socket 42 on the other throw side; the voltmeter 46 connected with the said power source positive line 34 and the power source negative line 34' in parallel by using the draw-out lines from the above lines with the check switch 44; and the power source E' for the lamp 26.

Figure 5:
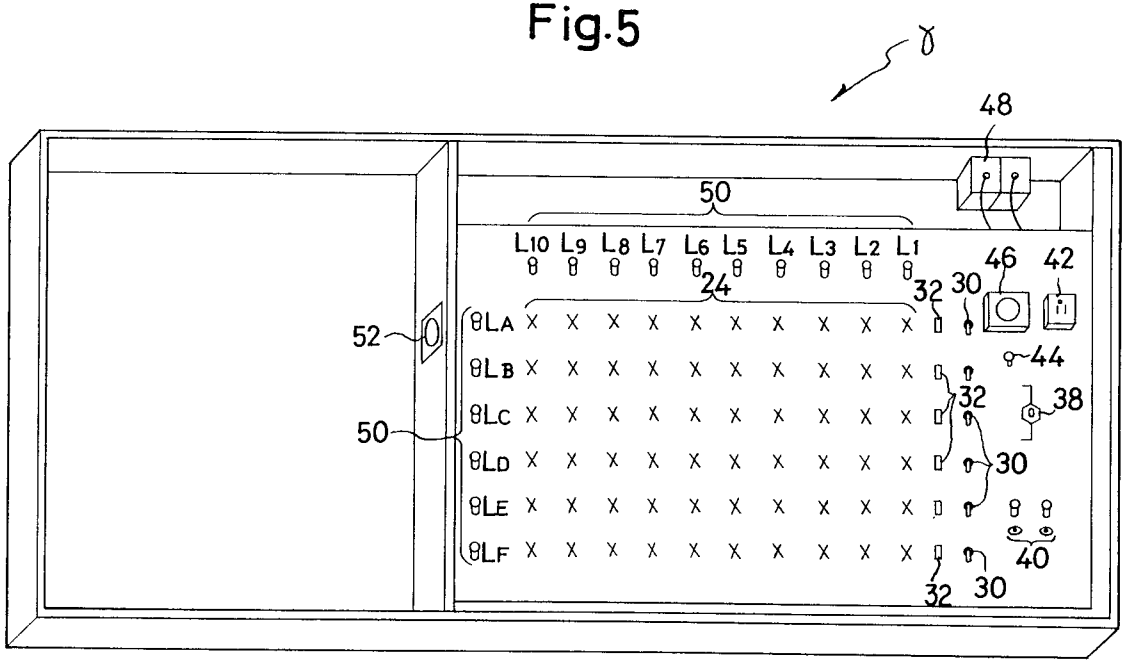
FIG. 5 is a slant drawing of the switch box board to house and package the circuit apparatus for operating fireworks ignition of this invention.

In FIG. 5, $\gamma$ shows the free portable switch box board for centralized remote operation to house and package the fireworks ignition operation circuit apparatus $\beta$ of the invention in perfect order, 48 is the battery box for the lamp power source E', 50 is the joint terminal with the conventional power line separately connecting the ten positive lines L1 to L10 and the six negative lines LA to LF inside, and 52 is the connecting joint with the 16-core cable which is not shown in the figure by bundling the ten positive lines L1 to L10 and the six negative lines LA to LF inside.

The number of the ignition operation switches 24, the block operation switches 30, the negative lines LA to LF, and the positive lines L1 to L10 is not limited to the number used in this embodiment.

According to the constitution of this invention as stated above, the connecting operation of the apparatus can be finished by connecting the positive lines L'1 to L'10 and the negative lines L'A to L'F of the fireworks ignition circuit $\alpha$ with the positive lines L1 to L10 and the negative lines LA to LF of the ignition operating circuit apparatus $\beta$ either by the 16-core cable or by the conventional wire and by plugging the power source E in the socket 42. As to the checking operation, the power source voltage can be measured if the check switch 44 is turned on after placing the main switch 38 on the side of the power source E, and the resistance value of the fireworks ignition circuit $\alpha$ connected to each ignition ball 10 can be measured if the main switch 38 is turned to the side of the test terminal 40 connected with a tester which is not shown in the figure, and the ignition operating switch 24 is closed and opened in turn with the block operation switch 30 closed. By these procedures, the conduction of the fireworks ignition circuit $\alpha$ can be checked successively, and whether the rated current needed for ignition is transmitted or not can also be easily calculated by dividing the power source voltage by the corresponding resistance value. At the same time, as the main switch 38 is cut off from the power source E in checking the conduction, there is no fear of the current transmitted to ignite the ignition ball 10 even if the block operation switch 30 and ignition operating switch 24 are closed, which means the improvement of safety problems.

For the ignition operation, on the other hand, place the main switch 38 on the side of the power source E, close any of the block operation switches 30, and close one or more ignition operating switches 24 commonly connected with the block positive line 28 and the block negative line 28' drawing out of the corresponding block operation switch 30. Then the ignition operation switch 24 will connect the positive terminal 20 with the positive lines L1 to L10 commonly used for each file, and the negative terminal 22 on the output side with the negative lines LA to LF commonly used for each step, so that the current is transmitted to the corresponding ignition ball 10 connected with the fireworks ignition circuit $\alpha$ to cause the ignition of fireworks.

The characteristics of the fireworks ignition circuit $\alpha$ and the functions of the block operation switch 30, the ignition pilot lamp 26, the block pilot lamp 32 of the ignition operating circuit apparatus $\beta$ will be explained next. If the current is simultaneously transmitted to A1 and C3 ignition balls 10 in the fireworks ignition circuit $\alpha$ shown in FIG. 3, it is noticed that the current will ignite A3 and C1 ignition balls 10 besides A1 and C3. Though no problem occurs as to the ignition balls 10 of the same step, it is very dangerous to transmit the current simultaneously to the ignition balls 10 of the other steps as it may cause to ignite the unintended ignition balls 10.

In this invention, the group of the block operating switch 30 are inserted between the group of the ignition operating switch 24 and the main switch 38 so that the current may not be transmitted unless the block operation switch 30 of a step is not closed even if the ignition operating switch 24 of other steps are closed while any of the ignition operating switches 24 is closed to make the live live. The simultaneous transmission of the currency owing to an erroneous operation is prevented by this structure.

The reason why this block operation switch 30 opens and closes both of the block positive line 28 and the block negative line 28' is as follows: suppose it opens and closes only one of the above lines, an erroneous operation of the ignition operating switch 24 of C3 in FIG. 4 while A1 ignition operating switch 24 is closed, for example, will cause C1 or A3 ignition ball 10 besides A1 in the fireworks ignition circuit to be ignited even through the block operation switch 30 in the 3rd step from the top is open.

In addition, each block pilot lamp 32 is connected with a pole of the block operation switch 30, and it is simultaneously lighted when the block operation switch 30 is closed so that the group of the ignition operating switch 24 to be operated may be indicated clearly.

As stated above, the clock operation switch 30 prevents the simultaneous transmission of current by an erroneous operation, and the block pilot lamp 32 prevents the occurrence of an erroneous operation itself.

The ignition operating switch 24 must be quickly turned open after ignition as it may cause the simultaneous transmission of current by an erroneous operation if it is left closed. In this apparatus one of the three poles of every ignition operating switch, P3, is connected with the ignition pilot lamp 26 to be lighted while the circuit is closed so that the operator may not forget while the circuit is closed so that the operator may not forget to open the ignition operating switch 24.

Thus the fireworks ignition operating circuit apparatus of this invention has made it possible to optionally transmit the current to the fireworks ignition circuit, and at the same time it has excellent features of practical use and utility as it secures the safety of fireworks ignition operation by the application of the block operation switch, the block pilot lamp, and the ignition pilot lamp, and it also facilitates the checking operation of conduction and the measurement of voltage before ignition of fireworks.

What we claim is:

1. A circuit apparatus for operating fireworks ignition comprising: a group of ignition operating switch means each having a plural number of pole means, positive terminal means and negative terminal means on the output side of said ignition operating switch means and connected respectively with each of positive line means commonly used for each file and with each of negative line means commonly used for each step of a circuit means, said positive line means and said negative line means being lined up in a plurality of vertical steps and horizontal files; an ignition pilot lamp means commonly connected with a pole of each of said ignition operating switch means to be lighted when even one of said ignition operating switch means is closed; and a group of block operation switch means having a plural number of pole means to perform on/off operation of a power source supply means in common with each file of said group of ignition operating switch means.

2. A circuit apparatus for operating fireworks ignition according to claim 1, in which said block operation switch means of three poles, two has which respectively open and close corresponding block positive line means and block negative line means commonly connecting each of said group of ignition operating switch means on the same step and a third additional pole means which is connected with a block pilot lamp means to be lighted when said block operation switch means closed.

3. A circuit apparatus for operating fireworks ignition according to claim 2, in which said group of block operation switch means is connected with a voltmeter means through a check switch means and to an intermediate terminal means of a power source positive line means and a power source negative line means commonly connected with two pole means on the input side corresponding to said block positive line means and said block negative line means, and also with a double-pole double-throw main switch means connecting a test terminal means on one throw side.

4. A circuit apparatus for operating fireworks ignition comprising circuit means having positive line means commonly used for each of a plurality of horizontal files and negative line means commonly used for each of a plurality of vertical steps, a group of ignition operating switch means each having a plurality of poles means, positive terminal means and negative terminal means on the output side of each of said ignition operating switch means and connected respectively with each of said positive line means and each of said negative line means, an ignition pilot lamp means commonly connected with a pole means of each of said ignition operating switch means and which is lighted when at least one of said ignition operating switch means is closed, and a group of block operating switch means each of which is in common with a file of said group of ignition operating switch means, said block operating switch means perform on/off operation of a power source supply means.

5. A circuit apparatus according to claim 4 further comprising block pilot lamp means to be lighted when a respective block operating switch means is closed, said circuit means further comprises block positive line means and block negative line means commonly connecting each of said ignition operating switch means on the same step, said block operating switch means having three pole means, two of said pole means opening and closing said block positive line means and said block negative line means respectively, and a third pole means of said block operating switch means connected to said block pilot lamp means to be lighted when the respective block operating switch means is closed.

6. A circuit apparatus according to claim 5, further comprising a voltmeter means and a check switch means, said group of block operation switch means being connected to said voltmeter means through said check switch means, a two pole means, an intermediate terminal means of a power source positive line means and a power source negative line means commonly connected with said two pole means on the input side corresponding to said block positive line means and said block negative line means, a test terminal, and a double-pole double-throw main switch means connecting said test terminal means on one throw side and said power source positive line means and said power source negative line means with said block positive line means and said block negative line means respectively on the other throw side.

* * * * *